US011706843B2

(12) United States Patent
Christiansen et al.

(10) Patent No.: US 11,706,843 B2
(45) Date of Patent: Jul. 18, 2023

(54) METHOD FOR CONTROLLING A COOKING PROCESS BY USING A LIQUID

(71) Applicant: ELECTROLUX APPLIANCES AKTIEBOLAG, Stockholm (SE)

(72) Inventors: Svend Erik Christiansen, Forli (IT); Gianluca Venturini, Forli (IT); Massimo Nostro, Forli (IT); Laurent Jeanneteau, Forli (IT); Alex Viroli, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 634 days.

(21) Appl. No.: 16/620,497

(22) PCT Filed: May 25, 2018

(86) PCT No.: PCT/EP2018/063754
§ 371 (c)(1),
(2) Date: Dec. 7, 2019

(87) PCT Pub. No.: WO2018/224332
PCT Pub. Date: Dec. 13, 2018

(65) Prior Publication Data

US 2020/0178357 A1 Jun. 4, 2020

(30) Foreign Application Priority Data

Jun. 9, 2017 (EP) ..... 17175255

(51) Int. Cl.
*H05B 1/02* (2006.01)
*F24C 3/12* (2006.01)
(Continued)

(52) U.S. Cl.
CPC ..... *H05B 1/0269* (2013.01); *F24C 3/126* (2013.01); *F24C 7/083* (2013.01); *H05B 6/062* (2013.01);
(Continued)

(58) Field of Classification Search
CPC .... H05B 1/0269; H05B 1/0284; H05B 6/062; H05B 6/065; H05B 6/6447;
(Continued)

(56) References Cited

U.S. PATENT DOCUMENTS 6,118,104 A * 9/2000 Berkcan ..... H05B 3/74 219/494
6,236,025 B1 5/2001 Berkcan et al.
(Continued)

FOREIGN PATENT DOCUMENTS

| | | | |
|---|---|---|---|
| EP | 2999301 | A1 | 3/2016 |
| GB | 2404293 | A | 1/2005 |
| JP | 2006134626 | A | 5/2006 |

OTHER PUBLICATIONS

International Search Report and Written Opinion in PCT/EP2018/063754 dated Aug. 8, 2018, 14 pages.
(Continued)

*Primary Examiner* — Hung D Nguyen
(74) *Attorney, Agent, or Firm* — Pearne & Gordon LLP

(57) ABSTRACT

The present invention relates to a method for controlling a cooking process by using a liquid in a cooking vessel, for example a cooking pot, upon a cooking hob (20). The method comprises a step of determining a cooking parameter of the liquid in the cooking vessel at a predetermined time (tB, tBP), a step of adjusting a heating power density (P) of a cooking zone of the cooking hob (20) for transferring a heating power (P) to the cooking vessel placed on the cooking zone; and a step of reducing the heating power
(Continued)

Figure 1:
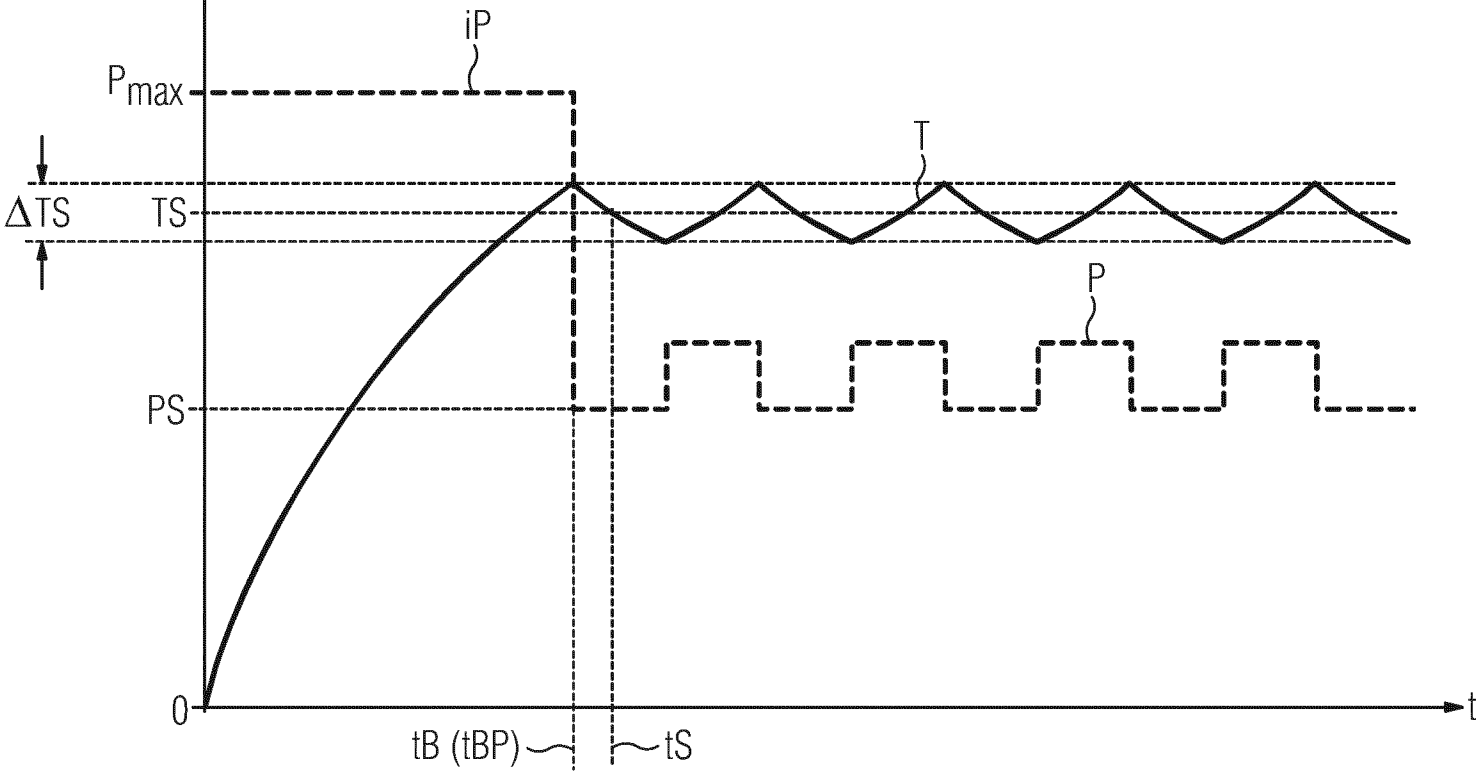

density (P) transferred to the cooking vessel from an initial power (iP) to a simmering power (PS). Further, the present invention relates to a cooking vessel for the cooking hob (20). Moreover, the present invention relates to a cooking appliance for performing the cooking process.

18 Claims, 4 Drawing Sheets

(51) Int. Cl.
*F24C 7/08* (2006.01)
*H05B 6/06* (2006.01)

(52) U.S. Cl.
CPC .... *H05B 2203/021* (2013.01); *H05B 2213/07* (2013.01)

(58) Field of Classification Search
CPC ..... H05B 2203/013; H05B 2203/017; H05B 2203/021; H05B 2213/03; H05B 2213/04; H05B 2213/05; H05B 2213/07; F24C 3/126; F24C 7/08; F24C 7/083
USPC ..... 219/445.1–448.19, 482–494, 620, 621, 219/627, 660–664, 667
See application file for complete search history.

(56) References Cited

U.S. PATENT DOCUMENTS

| | | | | |
|---|---|---|---|---|
| 2005/0247696 | A1* | 11/2005 | Clothier | H05B 3/746 219/497 |
| 2007/0080158 | A1* | 4/2007 | Takimoto | H05B 6/062 219/627 |
| 2013/0075388 | A1* | 3/2013 | Schilling | H05B 6/062 219/660 |
| 2017/0245327 | A1* | 8/2017 | Viroli | H05B 6/062 |

OTHER PUBLICATIONS

EPO Communication for counterpart application No. EP 17175255.3 dated Feb. 15, 2022, 6 pages.
EPO Communication for counterpart application No. EP 17175255.3 dated Jan. 19, 2021, 6 pages.
Australian Office action for application No. AU2018280071 dated Jul. 14, 2022, 3 pages.

* cited by examiner

METHOD FOR CONTROLLING A COOKING PROCESS BY USING A LIQUID

The present invention relates to a method for controlling a cooking process by using a liquid in a cooking vessel upon a cooking hob. Further, the present invention relates to a cooking vessel for a cooking hob. Moreover, the present invention relates to a cooking hob for performing a cooking process. Preferably, the cooking hob is an induction cooking hob.

In a cooking process based on liquids, in particular water, e.g. for cooking of pasta, rice, meat or vegetables in a cooking vessel, in particular a pot, deep pan, paella pan or the like, ideally at first the liquid is brought to boiling and subsequently the liquid is maintained simmering as long as it is required for achieving the intended cooking result. In connection therewith, there is an unfelt need of automatisation and/or assistance with regard to cooking. Particularly, it would be advantageous, if subsequent to boiling of the liquid, preferably brought to boiling as soon as possible, the boiling is automatically recognised. Preferably, the simmering subsequently is automatically maintained, so that no undesired spill-over due to bubbling and/or vaporisation of the cooking liquid due to unnecessary heating occurs.

It is an object of the present invention to provide a method for controlling a cooking process by using a liquid in a cooking vessel upon a cooking hob, wherein said cooking process is controlled automatically by low complexity.

According to the present invention a method for controlling a cooking process by using a liquid in a cooking vessel, for example a cooking pot, upon a cooking hob is provided, wherein said method comprises:

a) a step of determining a cooking parameter of the liquid in the cooking vessel at a predetermined time, b) a step of adjusting a heating power density of a cooking zone of the cooking hob for transferring a heating power to the cooking vessel placed on said cooking zone, and c) a step of reducing the heating power density transferred to the cooking vessel from an initial power to a simmering power.

In particular, the cooking parameter of the liquid in the cooking vessel is a thermal state, preferably a boiling state.

Further, the heating power density may be reduced in step c), after the boiling state of the liquid in the cooking vessel has been occurred or should have been occurred.

Preferably, step c) is carried out after the liquid having reached or being assumed to have reached a further cooking parameter, in particular a further thermal state. Said further thermal state may be the boiling of the liquid in the cooking vessel. In other words, step c) is preferably carried out after the boiling of the liquid in the cooking vessel has been occurred or should have been occurred.

According to a preferred embodiment of the present invention the method comprises at least one of the further steps d) a step of adjusting the heating power density of the cooking zone of the cooking hob for transferring the simmering power to the cooking vessel placed on said cooking zone, and/or e) maintaining a simmering of the liquid in the cooking vessel, preferably for a predetermined amount of time.

Preferably, step d) is carried out subsequently to step c). More preferably, step d) is carried out subsequently to step c) and before step e).

In particular, the method considers the boiling state and simmering state as two different thermal states of the liquid.

The boiling state refers to the state of the liquid, in which the temperature of said liquid reaches the boiling point. The simmering state refers to the state of the liquid, in which the temperature of said liquid is marginally smaller than the temperature of the boiling point. A person skilled in the art will immediately acknowledge that "simmering" refers to a food preparation technique in which foods are cooked in hot liquids kept just below the boiling point of water, but higher than poaching temperature. To keep a pot simmering, one brings it to a boil and then reduces the heat to a point where the formation of bubbles has almost ceased. Accordingly, the simmering state as used herein preferably refers to a water temperature of more than about 94° C. at sea leveland less than about 100° C. at average sea level air pressure.

A boiling power of the liquid refers to the power, which is sufficient that the temperature of said liquid reaches the boiling point. The simmering power refers to the power, which is suitable for maintaining said liquid in the simmering state.

Preferably, the simmering power is determined until the liquid in the cooking vessel has been boiled and/or in dependence of the predicted or estimated time until the liquid in the cooking vessel boils. In this case, the predetermined time in step a) is the predicted or estimated time until the liquid in the cooking vessel boils.

Further, the determination in step a) may include a step of detecting the boiling state of the liquid in the cooking vessel and/or a step of predicting and/or estimating the boiling state of the liquid in the cooking vessel.

The method of the present invention uses either the detected time until the liquid in the cooking vessel has been boiled or the predicted or estimated time until the liquid in the cooking vessel boils is used for determining the simmering power. The liquid in the cooking vessel may be, but not necessarily, boiling, when the power transferred to the cooking vessel is reduced. The boiling of the liquid may be detected by a sensor, so that the method may be performed by low complexity. Preferably, the steps of the method are performed preferably in that order as listed above.

In particular, in the beginning of the cooking process the liquid in the cooking vessel is heated up by transferring the initial power to said cooking vessel, wherein said initial power is more than 70%, in particular more than 80%, preferably more than 90%, more preferably more than 95%, most preferably more than 99%, of the maximum allowed power. The lower initial power has the advantage of saving energy, wherein the time delay is negligible. Saving energy is thereby preferably achieved due to reduced losses in the induction coil. The higher initial power has the advantage that the boiling state is quickly achieved.

The term "maximum allowed power" preferably refers to the power, which is the maximum transferable power, particularly the maximum transferable power to the cooking vessel.

It will be immediately understood by a person skilled in the art that the steps according to the method of the present invention can be carried out in the order mentioned above or alternatively in a different order. Preferably, the steps according to the method of the present invention are carried out in the order as outlined herein.

Alternatively, in the beginning of the cooking process the liquid in the cooking vessel is heated up by transferring the maximum allowed power. In this case, the boiling state is achieved as soon as possible.

Further, the step of determining the boiling state of the liquid is repeated at predetermined times, wherein preferably the step of detecting the boiling state of the liquid in the cooking vessel is repeated at predetermined times.

For example, the simmering power PS is determined by the equation $$PS=PS\max\times tB/tB\max,$$

wherein PSmax is the maximum simmering power, tB is the detected time until the liquid has been boiled in the cooking vessel and tBmax is the maximum realistic time until the liquid boils. The maximum simmering power as well as the maximum realistic time until the liquid boils may be experimental or empirical values.

Alternatively, the simmering power PS may be determined by the equation $$PS=PS\max\times tBP/tB\max,$$

wherein tBP is the predicted or estimated time until the liquid boils in the cooking vessel. The predicted or estimated time until the liquid boils in the cooking vessel may be determined on the basis of other detected and/or inherent parameters.

Preferably, the simmering power PS is determined with the subsidiary condition:

$$PS\min\leq PS<PS\max,$$

wherein PSmin is the minimum simmering power. This subsidiary condition avoids boilover and cooling down of the liquid.

In particular, the boiling of the liquid in the cooking vessel is detected by a vibration sensor and/or temperature sensor. The vibration sensor and the temperature sensor are reliable and cost-efficient components.

For example, the boiling of the liquid in the cooking vessel is detected by a microelectromechanical systems (MEMS) accelerometer. Said MEMS accelerometer detects the vibrations caused by bubbles formed in the liquid.

Moreover, vibration data from the vibration sensor may be used to implement a closed control loop on the simmering power. For example, a suitable vibration sensor is a microelectromechanical systems (MEMS) accelerometer. Preferably, a filtered vibration level is used for determining the simmering power.

Further, a boil-over of the liquid in the cooking vessel is detected by the vibration sensor.

Moreover, the power transferred to the cooking vessel is detected or determined by a control device of the cooking hob. The power transferred to the cooking vessel is directly or indirectly detected or determined, particularly by other parameters.

Further, the present invention relates to a cooking vessel for a cooking hob, wherein said cooking vessel is provided for the method mentioned above.

For example, the cooking vessel comprises and/or is provided for receiving at least one vibration sensor and/or temperature sensor for detecting a boiling of a liquid in said cooking vessel.

In particular, the vibration sensor is a microelectromechanical systems (MEMS) accelerometer. The MEMS accelerometer detects the vibrations caused by bubbles formed in the liquid.

Moreover, the present invention relates to a cooking appliance for performing the method mentioned above and/or for using at least one aforesaid cooking vessel.

Preferably, the cooking appliance comprises at least one control device for adjusting the power transferred to the cooking vessel.

Moreover, the cooking appliance may comprise at least one temperature sensor for detecting the temperature and/or the boiling of the liquid in the cooking vessel.

Alternatively or additionally, the cooking appliance may comprise at least one control device for predicting or estimating the time until the liquid in the cooking vessel boils.

For example, the cooking appliance is a radiant cooking hob, an induction cooking hob and/or a gas cooking hob.

Further, the cooking appliance may comprise at least one heating energy unit for transferring heating power to at least one heating zone. A cooking zone comprises preferably at least one heating zone, more preferably at least two heating zones.

In particular, the heating energy unit may comprise at least one generator for providing heating power to the at least one heating zone. The heating power may be provided by heat, preferably by heat radiation.

Alternatively or additionally, the heating power may be provided by heat generating power, particularly by a heat generating magnetic field, more particularly by an induction field.

Preferably, the heating zone is associated with at least one heating power transferring element. Said heating power transferring element may particularly be a heating element, preferably an induction coil.

Further, a heating zone may be associated with more than one heating power transferring element. Particularly, a heating zone may be associated with two, three, four or more heating power transferring elements.

Moreover, the heating energy unit may comprise at least one generator for providing heating power to the at least one heating zone comprising at least one heating power transferring element, particularly at least one heating element, more particularly at least one induction coil.

It will be immediately understood that the heating energy unit may comprise one generator for providing heating power to more than one heating zone, each associated with at least one heating power transferring element.

Furthermore, the heating energy unit may comprise one generator comprising a single or pair of high frequency switching elements.

In particular, the high frequency switching element is provided in the form of a semiconductor switching element, particularly an IGBT element.

In case the heating energy unit may comprise one generator comprising a single high frequency switching element, the single switching element preferably forms a Quasi Resonant circuit.

In case that the heating energy unit may comprise one generator comprises a pair of high frequency switching elements, said pair of high frequency switching elements preferably forms a half-bridge circuit.

Novel and inventive features of the present invention are set forth in the appended claims.

Figure 2:
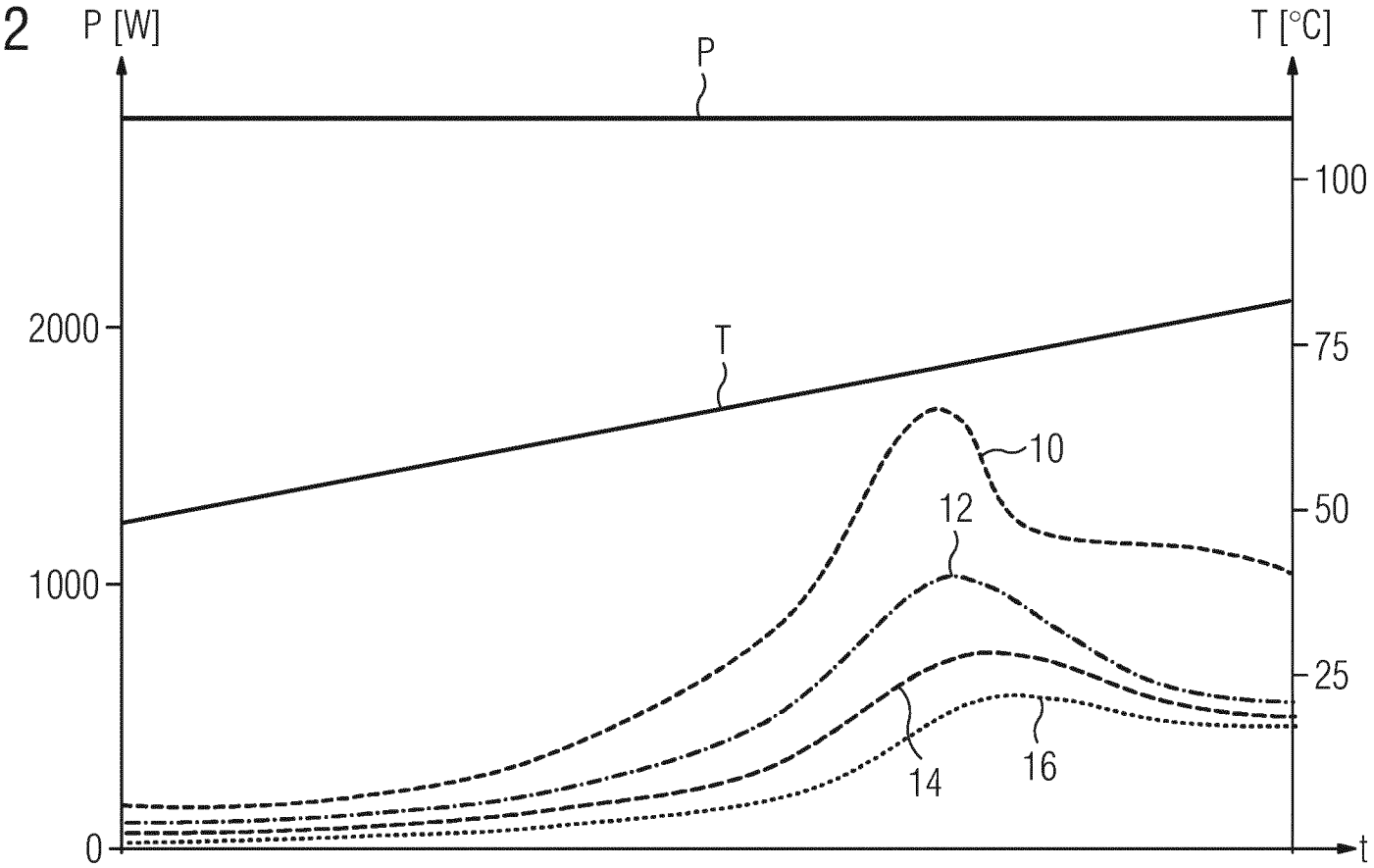
Figure 3:
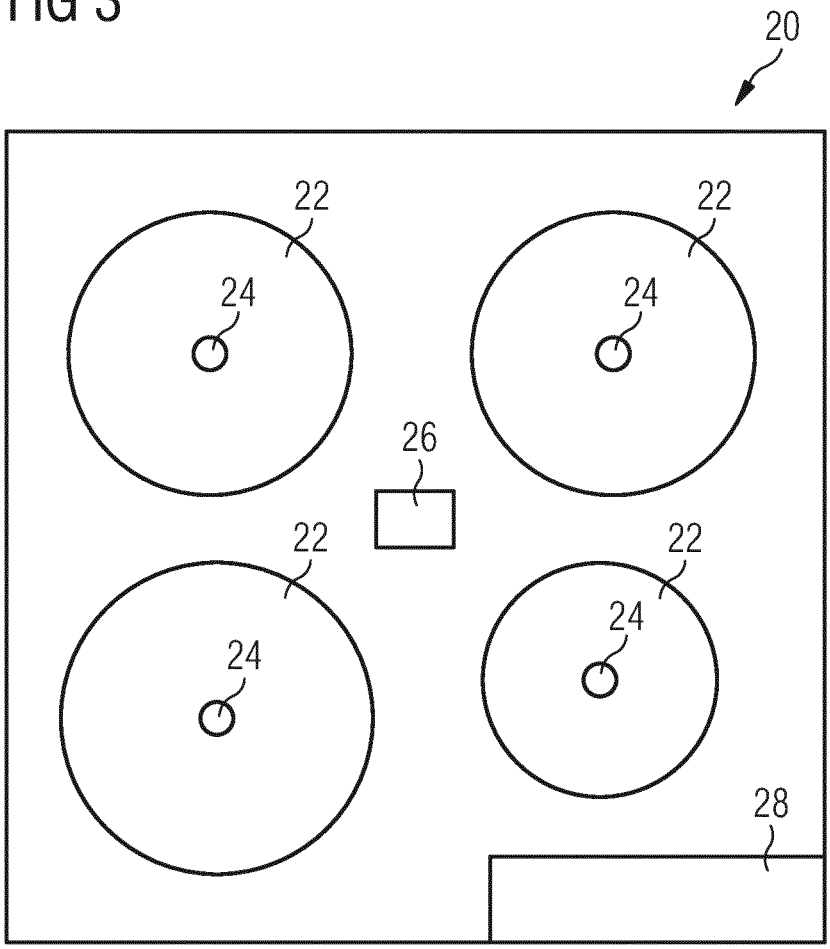
Figure 4:
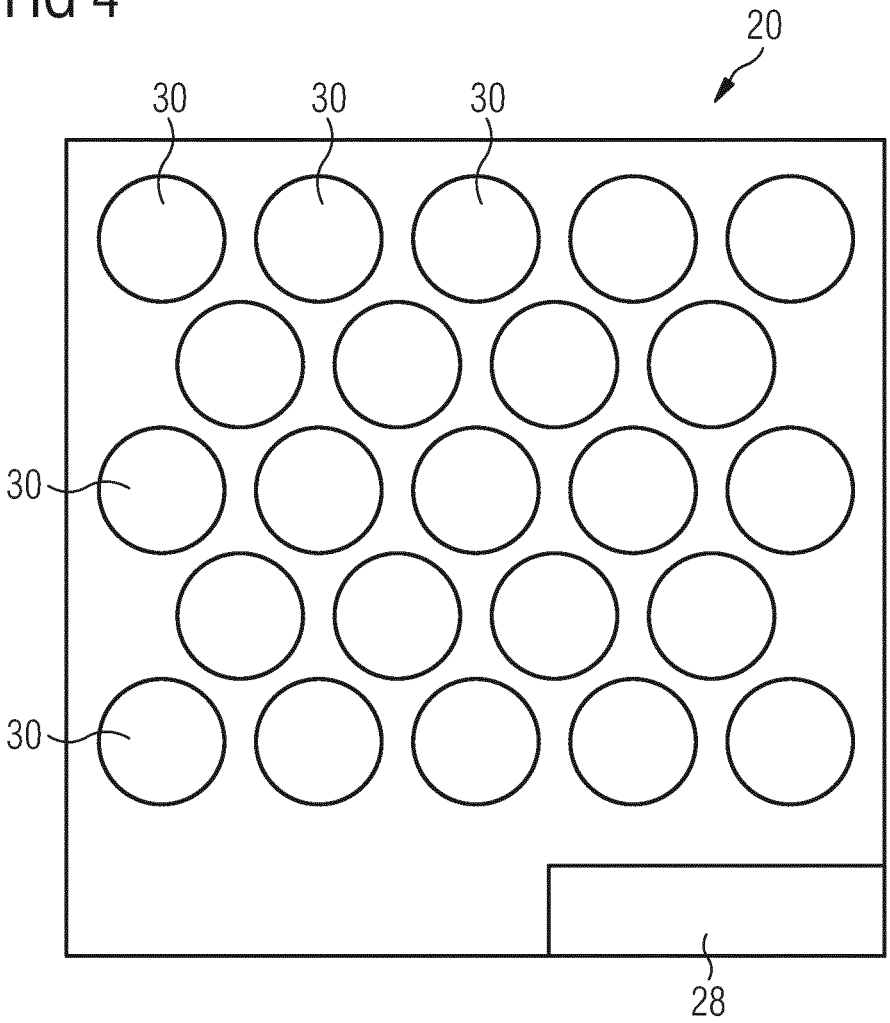

The present invention will be described in further detail with reference to the drawings, in which FIG. 1 illustrates a schematic diagram of the transferred power to a cooking vessel upon a cooking hob and the temperature of a liquid in said cooking vessel as function of the time during a cooking process controlled according to a preferred embodiment of the present invention, FIG. 2 illustrates a schematic diagram of the transferred power to the cooking vessel, the temperature of the liquid in said cooking vessel and vibration strengths of said liquid for several frequency ranges as function of the time during the cooking process controlled according to the preferred embodiment of the present invention, FIG. 3 illustrates a schematic top view of the cooking hob according to a preferred embodiment of the present invention, and FIG. 4 illustrates a schematic top view of the cooking hob according to a further embodiment of the present invention.

FIG. 1 illustrates a schematic diagram of the transferred power P to a cooking vessel upon a cooking hob and the temperature T of a liquid in said cooking vessel as function of the time t during a cooking process controlled according to a preferred embodiment of the present invention. For example, the liquid in the cooking vessel is water, soup, sauce or the like. Further, additional food, e.g. pasta, rice, meat, vegetable or the like, may be inside the cooking vessel with water. The cooking vessel may be a cooking pot, a deep pan, a paella pan or the like.

Before the cooking process starts, the liquid has usually ambient temperature. At the beginning of the cooking process, a very high initial power iP is transferred to the cooking vessel, so that the temperature T of the liquid inside the cooking vessel increases steadily. Preferably, the initial power iP transferred to the cooking vessel is more than between 70% and 99% of the maximum allowed power Pmax. When boiling of the liquid is detected at a boiling time tB, then the transferred power P is reduced from the high power value to a simmering power PS. The detected boiling time tB is the time interval from the beginning of the cooking process until the liquid boils. Alternatively, a predicted or estimated boiling time tBP until the liquid boils may be predicted or estimated otherwise, wherein the transferred power P is reduced from the high power value to the simmering power PS, after said predicted or estimated boiling time tBP has been reached. The transferred power P may be determined by a control device of the cooking hob.

After the boiling of the liquid has been detected or the predicted or estimated boiling time tBP has been reached, respectively, the transferred power P is reduced from the high power value to the simmering power PS. Then, the temperature T of the liquid oscillates around a simmering temperature TS with a variation ΔTS of said simmering temperature TS. In this example, the simmering temperature TS as function of the time t is a triangular signal, while the transferred power P is a square signal. The temperature T of the liquid is detected by a temperature sensor.

After the detection of boiling at t=tB or t=tBP, respectively, the transferred power P is maintained at the simmering power PS. For example, the transferred power P is regulated by a closed control loop in order to keep the temperature T close to the simmering temperature TS. In the latter case, vibration data from a vibration sensor may be used to implement the closed control loop on the simmering power PS. For example, a filtered vibration level is used for determining the simmering power PS. Moreover, a boil over detection may be performed by the vibration data. Further, the transferred power P may be regulated manually by a user, wherein preferably said transferred power P is adjustable by the user only within a limited range, so that adjustment errors by the user are avoided. If the predicted or estimated boiling time tBP is used, then a boilover of the liquid may be reduced manually.

The simmering temperature TS may be detected by a temperature sensor at a simmering time tS. Said simmering time tS occurs shortly after the detected boiling time tB or the predicted or estimated boiling time tBP, respectively, after the transferred power P has been reduced from the maximum allowed power Pmax to the simmering power PS. The detected simmering temperature TS may be used as a set point for controlling the simmering power PS. Further, the simmering temperature TS may be determined by detecting the temperature T of the liquid at the beginning of the cooking process and when the liquid boils.

For example, the simmering power PS is determined by:

$$PS=PS\text{max}\times tB/tB\text{max}$$

wherein PSmax is the maximum simmering power, tB is the detected time until the liquid boils in the cooking vessel and tBmax is the maximum realistic time until the liquid boils in the cooking vessel. Alternatively, the simmering power PS may be determined by:

$$PS=PS\text{max}\times tBP/tB\text{max},$$

wherein tBP is the predicted or estimated time until the liquid boils in the cooking vessel. Additionally, a subsidiary condition $$PS\text{min}\leq PS<PS\text{max}$$

may be set, wherein PSmin is the minimum simmering power. For example, the maximum simmering power PSmax is about 2000 W, while the minimum simmering power PSmin may be about 600 W.

The boiling of the liquid in the cooking vessel may be detected by the vibration sensor or by the temperature sensor. For example, a suitable vibration sensor is the microelectromechanical systems (MEMS) accelerometer. Said MEMS accelerometer detects the vibrations caused by bubbles formed in the liquid.

FIG. 2 illustrates a schematic diagram of the transferred power P to the cooking vessel, the temperature T of the liquid in said cooking vessel and vibration strengths 10, 12, 14 and 16 of said liquid for several different frequency ranges as function of the time during the cooking process controlled according to the preferred embodiment of the present invention. The diagrams of the vibration strengths 10, 12, 14 and 16 are obtained by filtering a signal from the vibration sensor, wherein said filtering may be performed by software or hardware.

The maximum allowed power Pmax is transferred to the cooking is vessel, wherein the temperature T of the liquid inside the cooking vessel increases steadily. In FIG. 2 the temperature T of the liquid in the cooking vessel increases from about 50° C. to about 80° C. Four diagrams 10, 12, 14 and 16 show vibration strengths for different frequency ranges. The vibration results from the movement of the bubbles in the liquid. A first diagram 10 relates to a frequency range from 0 Hz to 85 Hz. A second diagram 12 relates to a frequency range from 115 Hz to 170 Hz. A third diagram 14 corresponds with a frequency range from 225 Hz to 270 Hz, while a fourth diagram 16 is provided for a frequency range from 325 Hz to 400 Hz.

For each of the four frequency ranges, a maximum of the vibration strength occurs during the pre-boiling phase. In this example, the maxima of the vibration strengths occur, when the temperature T of the liquid is about 70° C. The biggest vibration strength occurs for the frequency range between 0 Hz to 85 Hz. Further, at temperatures higher than about 70° C., where the peak is situated, the vibration strengths for the frequency range between 0 Hz to 85 Hz are relative high. Thus, the ratio between said peak and the subsequent level is relative small. The peak of the vibration strength for the frequency range between 0 Hz to 85 Hz may be used as reference for the actual boiling.

Moreover, the vibration strength at the beginning of the cooking process and the maximum vibration strength during the pre-boiling phase may be recorded and used to determine adequate target vibration strength corresponding with the actual boiling. In this case, the vibration strength at the beginning of the cooking process is preferably recorded within the first minute of said cooking process. Then, the peak of the vibration strength during the pre-boil phase is recorded. The target vibration strength may be determined as a percentage value of an interim value between the vibration strength at the beginning of the cooking process and the peak of the vibration strength.

Moreover, a warning beep to the user may be activated, if over boiling is detected or estimated. Further, an automatic reduction of the transferred power is performed, if overboiling is detected or estimated.

The method for controlling the cooking process by using the liquid in the cooking vessel upon the cooking hob according to the present invention is suitable for each type of cooking hob. For example, the inventive method may be used for radiant cooking hobs, induction cooking hobs and/or gas cooking hobs.

FIG. 3 illustrates a schematic top view of the cooking hob 20 according to a preferred embodiment of the present invention. The cooking hob 20 comprises cooking zones 22, temperature sensors 24, a vibration sensor 26 and a control unit 28. Preferably, the cooking hob 20 is an induction cooking hob, wherein each cooking zone 22 includes at least one induction coil.

In this example, the cooking hob 20 comprises four cooking zones 22 arranged as a two-by-two matrix and four temperature sensors 24, wherein each temperature sensor 24 is arranged in the centre of a corresponding cooking zone 22. Alternatively, the temperature sensor 24 may be arranged in an arbitrary position within the corresponding cooking zone 22 or beside said cooking zone 22. Moreover, the temperature sensor 24 may be arranged inside or at the cooking vessel.

In this example, the vibration sensor 26 is arranged in a central portion between the four cooking zones 22. The distance between the vibration sensor 26 and each of the four cooking zones 22 is equal. Further, the cooking hob 20 may comprise more vibration sensors 26, wherein preferably each vibration sensor 26 is arranged between two or more adjacent cooking zones 22. For example, the cooking hob 20 may comprise a plurality of small induction coils arranged as a matrix, wherein preferably each vibration sensor 26 is arranged in a centre between two or more adjacent induction coils. Moreover, each cooking zone 22 may correspond with one vibration sensor 26, wherein said cooking zone 22 includes one or more inductions coils.

FIG. 4 illustrates a schematic top view of the cooking hob 20 according to a further embodiment of the present invention. The cooking hob 20 of the further embodiment is provided for a so-called cook-anywhere function, wherein the cooking vessel may be placed at an arbitrary position on said cooking hob 20.

The cooking hob 20 of the further embodiment comprises a plurality of heating zones 30. Moreover, the cooking hob 20 comprises the control unit 28. Each heating zone 30 includes one or more heating elements. In this example, the heating elements are inductions coils. Alternatively, the heating elements may be radiant heating elements. In general, the heating elements may be arbitrary heating elements.

The induction coils are connected to corresponding induction generators. Different combinations of induction generators and induction coils are possible. For example, a pair of IGBT elements forms a half-bridge circuit and/or a quasi-resonant circuit. In general, arbitrary suitable semiconductor elements may be used for the induction generator. Moreover, arbitrary usual induction generators may be used for the cooking hob 20.

One induction generator may be connected to one or more induction coils. The induction generator may be supplied by a single-phase, two-phase and/or three-phase alternating current.

Further, the cooking hob 20 comprises at least one temperature sensor 24, at least one vibration sensor 26 and at least one pot detection sensor, which are not explicitly shown in FIG. 4. For example, the temperature sensor 24 may be arranged in the centre of the heating zone 30 and/or between adjacent heating zones 30. Preferably, the vibration sensor 26 is a microelectromechanical systems (MEMS) accelerometer.

The cooking zone is defined by those heating zones 30, which are completely or partially covered by the cooking vessel. Said cooking vessel may be placed at an arbitrary position on the cooking hob 20 by the user. The one or more pot detection sensors recognise the position of the cooking vessel and the heating zones 30 covered by said cooking vessel. The heating zones 30 covered by the cooking vessel are activated, while the empty heating zones 30 remain deactivated.

The cooking hob 20 comprises at least one heating energy unit for transferring heating power to the activated heating zones 30. The heating energy unit comprises at least one generator for providing heating power to the activated heating zones 30. The heating is provided by heat generating power, particularly by a heat generating magnetic field, more particularly by an induction field.

Preferably, the heating zone 30 is associated with at least one heating power transferring element, wherein said heating power transferring element is particularly a heating element, preferably an induction coil.

Further, the heating zone 30 may be associated with more than one heating power transferring element. In particular, the heating zone 30 is associated with two, three, four or more heating power transferring elements.

Moreover, the heating energy unit may comprise at least one generator for providing heating power to the at least one heating zone 30 comprising at least one heating power transferring element, particularly at least one heating element, more particularly at least one induction coil.

It will be immediately understood that the heating energy unit may comprise one generator for providing heating power to more than one heating zone 30, each associated with at least one heating power transferring element.

Furthermore, the method according to the present invention may be integrated within an assisted cooking function. For example, application software (APP) includes algorithms for performing the inventive method. The method may be supported by the internet. The current status of the cooking process may be visualised by a display device. Said display device may be a part of the cooking hob 20, a separate device connectable to the cooking hob 20 or a part of a remote control transmitter. Said remote control transmitter may be wireless connected to the cooking hob 20. Further, the remote control transmitter may be connected to the cooking hob 20 via the internet. For example, the remote control transmitter may be a notebook, a smartphone or the like.

Although an illustrative embodiment of the present invention has m been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

P transferred power to the cooking vessel
T temperature of the liquid in the cooking vessel
t time
Pmax maximum allowed power
iP initial power
TS simmering temperature
ΔTS variation of the simmering temperature
PS simmering power
PSmax maximum simmering power
PSmin minimum simmering power
tB detected time until the liquid boils
tBP predicted or estimated time until the liquid boils
tS simmering time
tBmax maximum realistic time until the liquid boils
10 vibration strength for frequencies from 0 Hz to 85 Hz
12 vibration strength for frequencies from 115 Hz to 170 Hz
14 vibration strength for frequencies from 225 Hz to 270 Hz
16 vibration strength for frequencies from 325 Hz to 400 Hz
20 cooking hob
22 cooking zone
24 temperature sensor
26 vibration sensor
28 control unit
30 heating zone

The invention claimed is:

1. A method for controlling a cooking process by using a liquid in a cooking vessel upon a cooking hob, wherein said method comprises:

a) determining a cooking parameter of the liquid in the cooking vessel at a predetermined time, b) adjusting a heating power density of a cooking zone of the cooking hob for transferring the heating power density to the cooking vessel placed on said cooking zone, c) reducing the heating power density transferred to the cooking vessel from an initial power to a simmering power (PS), detecting a simmering temperature of the liquid in the cooking vessel, and controlling the simmering power (PS) based on the detected simmering temperature, wherein the simmering power (PS) is regulated according to the following condition: PSmin≤PS≤PSmax, wherein PSmin is a minimum simmering power and PSmax is a maximum simmering power.

2. The method according to claim 1, wherein the heating power density is reduced in step c), after a boiling state of the liquid in the cooking vessel has been occurred or should have been occurred.

3. The method according to claim 1, further comprising:

d) adjusting the heating power density of the cooking zone of the cooking hob for transferring the simmering power to the cooking vessel placed on said cooking zone, and/or e) maintaining a simmering of the liquid in the cooking vessel for a predetermined amount of time, wherein the simmering power is determined until the liquid in the cooking vessel has been boiled and/or in dependence of the predicted or estimated time until the liquid in the cooking vessel boils.

4. The method according to claim 1, wherein the determination in step a) further includes detecting a boiling state of the liquid in the cooking vessel and/or predicting and/or estimating the boiling state of the liquid in the cooking vessel.

5. The method according to claim 4, wherein the step of detecting the boiling state of the liquid in the cooking vessel is repeated at predetermined times.

6. The method according to claim 1, wherein in a beginning of the cooking process the liquid in the cooking vessel is heated up by transferring the initial power to said cooking vessel, wherein said initial power is more than 70% of a maximum allowed power.

7. The method according to claim 1, wherein in a beginning of the cooking process the liquid in the cooking vessel is heated up by transferring a maximum allowed power.

8. The method according to claim 1, wherein:

the simmering power (PS) is determined by the equation $$PS=PS\max\times tB/tB\max,$$

wherein tB is a detected time until the liquid has been boiled in the cooking vessel, and tBmax is a maximum realistic time until the liquid boils, or the simmering power (PS) is determined by the equation $$PS=PS\max\times tBP/tB\max,$$

wherein tBP is a predicted or estimated time until the liquid boils in the cooking vessel and tBmax is the maximum realistic time until the liquid boils.

9. The method according to claim 1, wherein boiling of the liquid in the cooking vessel is detected by a vibration sensor and/or temperature sensor.

10. The method according to claim 9, wherein vibration data from the vibration sensor are used to implement a closed control loop on the simmering power, wherein a filtered vibration level is used for determining the simmering power.

11. The method according to claim 9, wherein a boil-over of the liquid in the cooking vessel is detected by the vibration sensor.

12. The method according to claim 1, wherein the heating power density transferred to the cooking vessel is detected or determined by a control device of the cooking hob.

13. A cooking appliance for performing a cooking process, comprising at least one control device configured to adjust power transferred to the cooking vessel according to the method of claim 1.

14. The cooking appliance according to claim 13, wherein the cooking appliance is a radiant cooking hob, an induction cooking hob and/or a gas cooking hob.

15. The cooking appliance according to claim 13, wherein the cooking appliance comprises at least one temperature sensor configured to detect the temperature and/or the boiling of the liquid in the cooking vessel.

16. The cooking appliance according to claim 13, wherein the cooking appliance comprises at least one control device configured to predict or estimate a time until the liquid in the cooking vessel boils.

17. A method of controlling a cooking process using a heating element to transfer cooking power to a liquid in a cooking vessel, comprising:

beginning at a start of the cooking process, transferring an initial power to the cooking vessel, said initial power being at least 70% of a maximum allowable power that can be transferred to the cooking vessel by said heating element;

continuing to transfer said initial power to the cooking vessel until boiling of the liquid therein at its boiling temperature is detected via a vibration sensor at a boiling time elapsed from the start of the cooking process;

beginning at the boiling time, reducing power transferred to the cooking vessel from said initial power to a simmer power that falls within a simmer-power range between a maximum simmer power level and a minimum simmer power level, both of which being below the initial power;

establishing a simmer temperature marginally below the boiling temperature by measuring the temperature of said liquid at simmering time occurring at a predetermined interval after said boiling time; and regulating the simmer power within said simmer-power range according to a closed control loop to maintain the temperature of said liquid within a predetermined temperature range whose upper bound does not exceed said boiling temperature and which bounds said simmer temperature, said closed control loop being based on feedback from at least one of said vibration sensor sensing vibrations in the liquid in said cooking vessel, which vibrations are correlated to a proximity of said liquid to the simmer temperature, or a temperature sensor sensing the temperature of said liquid.

18. The method according to claim 17, said predetermined temperature range having bounds of 94° C. and 100° C.

* * * * *